US005303425A

United States Patent [19]

Mele

[11] Patent Number: 5,303,425

[45] Date of Patent: Apr. 19, 1994

[54] INFLATABLE CLOTHING APPARATUS

[76] Inventor: Peter C. Mele, P.O. Box 533, Crown Point, N.Y. 12928

[21] Appl. No.: 117,781

[22] Filed: Sep. 7, 1993

Related U.S. Application Data

[63] Continuation-in-part of Ser. No. 900,660, Jun. 19, 1992, abandoned.

[51] Int. Cl.[5] ..... A41B 1/00

[52] U.S. Cl. ..... 2/115; 2/2; 2/102; 2/108; 2/DIG. 1; 2/DIG. 3

[58] Field of Search ..... 2/115, 2.1 A, 2.1 R, 2/2, 102, 108, DIG. 1, DIG. 3; 446/220, 226, 225; 128/202.13, 202.14, 202.16, 30.2, 38, 204.17, 202.19, 118, 873, 874; 441/106, 107, 108

[56] References Cited

U.S. PATENT DOCUMENTS

| | | | |
|---|---|---|---|
| 2,632,176 | 3/1953 | Mitchell | 2/DIG. 3 |
| 3,045,243 | 7/1962 | Lash et al. | 2/DIG. 3 |
| 3,122,754 | 3/1964 | Wedin | 2/115 |
| 4,271,833 | 6/1981 | Moretti | 2/2.1 A |
| 4,310,927 | 1/1982 | DeBose | 2/115 |
| 4,847,919 | 7/1989 | Hwang et al. | 2/DIG. 1 |
| 4,870,706 | 10/1989 | Ketcham et al. | 2/2 |
| 4,964,282 | 10/1990 | Wagner | 2/DIG. 1 |

FOREIGN PATENT DOCUMENTS

| | | | |
|---|---|---|---|
| 2459012 | 6/1979 | France | 2/DIG. 1 |

*Primary Examiner*—Clifford D. Crowder
*Assistant Examiner*—Gloria Hale
*Attorney, Agent, or Firm*—Thomas N. Neiman

[57] ABSTRACT

The inflatable clothing apparatus is designed to provide an inflatable (on position) and deflatable (off position) convection cooled clothing. The apparatus contains a spiralled inner tubular structure attached to the inner portion of the shirt and the inner tubular structure has separate expansion points connected by the air tube. When the expansion points are inflated lifting the shirt away from the skin and opening the cooling flap at the lower rear portion of the shirt, air circulation increases to the skins surface by allowing air to convect upward from the lower flap out through the neck opening. Air passages are also located in the shoulder and upper back area. A release mechanism (valve) is provided to allow deflation of the expansion points in order to provide warmth for the user by closing the flap and having the shirt contact the skin.

4 Claims, 2 Drawing Sheets

INFLATABLE CLOTHING APPARATUS

This is a continuation in part application of Ser. No. 07/900,660 filed Jun. 19, 1992 that has been abandoned.

BACKGROUND OF THE INVENTION

This invention pertains to clothing and outdoor clothing, in particular, to an inflatable clothing apparatus that is designed to be used by individuals engaged in outdoor activities where there is exertion requiring cooling followed by inactivity requiring warmth, such as hunting, fishing, hiking or cross country skiing.

There have been a number of attempts made to provide clothing that allows the air to circulate providing cooling. U.S. Pat. No. 3,122,754 shows an undershirt with vertical cords that is designed to create a space between the undershirt and the overshirt. U.S. Pat. No. 3,045,243 shows a shirt in a jacket which is designed to draw air through vents that are defined by means of springs. One of the difficulties is that you cannot turn these units off and there is no air inlet for convection.

Clearly, it is desirable for an apparatus of this type to be very lightweight and flexible. At the same time, the apparatus should be easy to manufacture be extremely simple to operate, both in allowing the circulation of air and also restrict the circulation of air when necessary. In other words, to be a flexible apparatus which will allow the individual to have the comfort he or she desires simply and easily. Another object of this invention is to provide an apparatus that has an ease of manufacture and ease of assembly. It is an object of this invention to set forth an improved inflatable clothing apparatus which avoids the disadvantages, limitations, above-recited, obtained from prior air circulation clothing apparatus.

SUMMARY OF THE INVENTION

Particularly, it is the object of this invention to set forth an inflatable clothing apparatus, for use by individuals active in outdoor pursuits, comprising an outer shell of clothing; said outer shell of clothing comprising flexible material; an inner tubular spiralled structure; said inner tubular spiralled structure having expansion points at spaced apart intervals along said spiralled structure; flap means located under said expansion points positioned at the lower rear portion of said outer shell; said expansion points lift said flap means when said expansion points are expanded for allowing ambient air to be introduced beneath said outer shell of clothing that convects upward and exits at the neck opening of said clothing; said inner tubular spiralled structure having means for allowing air to be pumped into said inner tubular spiralled structure; said inner tubular spiralled structure having means for retaining said air pumped into said inner tubular spiralled structure; and said inner tubular spiralled structure further having means for releasing said air pumped into said inner tubular spiralled structure.

BRIEF DESCRIPTION OF THE INVENTION

Further objects and features of this invention will become more apparent by reference to the following description taken in conjunction with the accompanying figure, in which.

DETAILED DESCRIPTION OF THE PREFERRED EMBODIMENT

Figure 1:
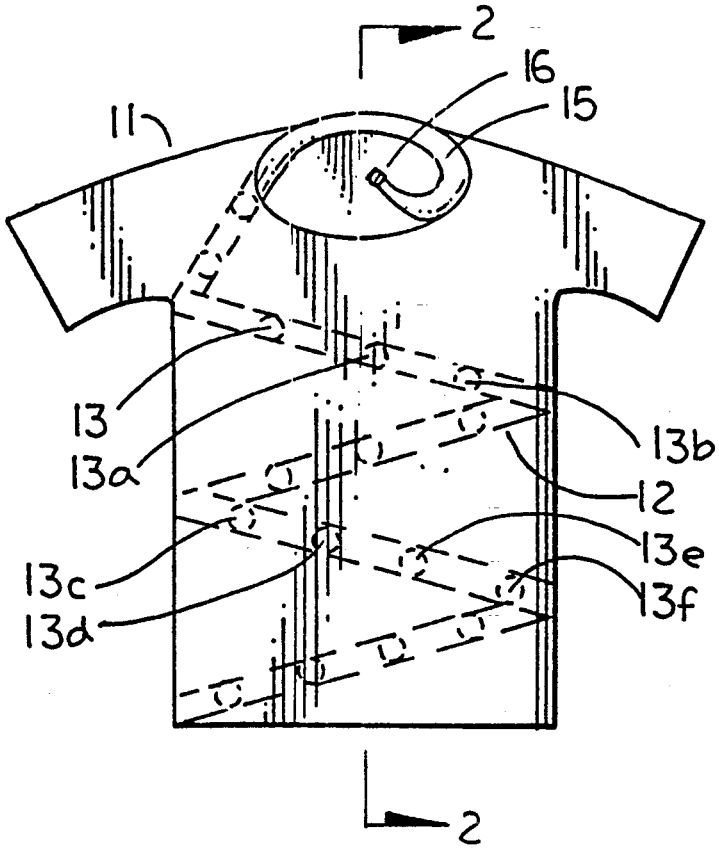
FIG. 1 is a front elevational view of the novel inflatable clothing apparatus.
Figure 2:
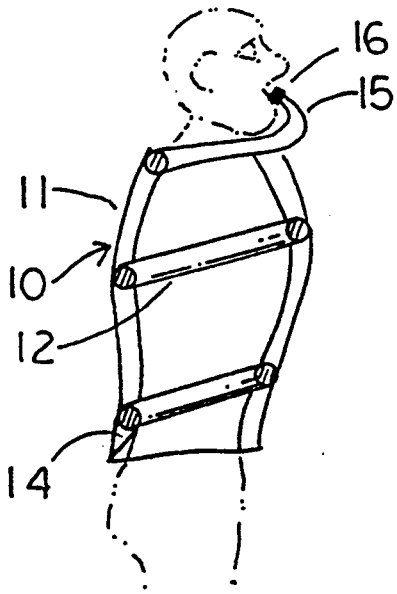
FIG. 2 is a cross-sectional view taken along line 2—2 of FIG. 1.
Figure 4:
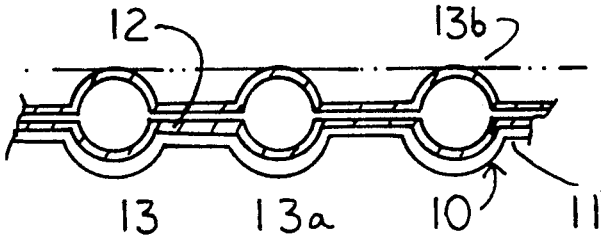
FIG. 4 is a top plan sectional view of the inner tubular structure.
Figure 3:
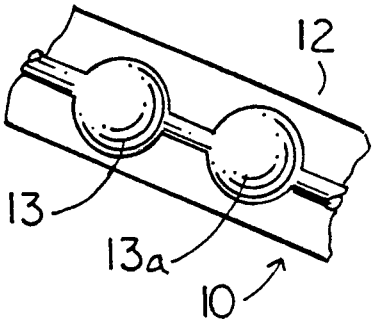
FIG. 3 is a side elevational sectional view of the inner tubular structure with the outer shirt removed for clarity.
Figure 5:
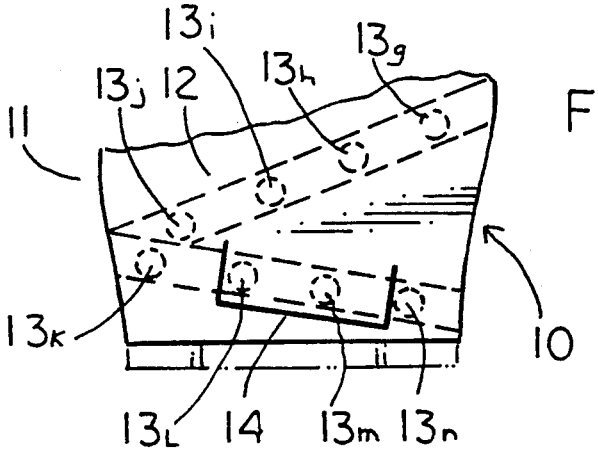
FIG. 5 is a side elevational view of the flap positioned under the outer shell.
Figure 6:
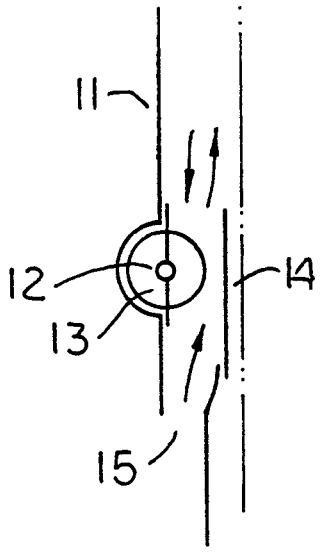
FIG. 6 is a cross sectional view of the expansion point and flap overview.

As shown in the figures, the novel inflatable clothing apparatus 10 comprises a shirt 11 that contains an interconnected spiralled inner tubular structure 12. The inner tubular structure is attached to the inside of the shirt 11 in one of a number of ways, such as glueing or the like. At spaced apart interval along the spiralled portions of the inner tubular structure, are a series of expansion points 13 through 13*f* on the front of the shirt and a similar number of expansion points 13*g* through 13*n* on the rear of the shirt. Above these expansion points on the lower rear portion (although they could be located on the sides or front of the shirt) of the shirt 11 are slits in the shirt itself along with a flap 14 under the slit. The flap 14 is an extension of the shirt 11 that extends up under the slit in the shirt 11. The expansion points 13 through 13*n* are merely points along the inner tubular structure 12 that are manufactured to inflate more than the surrounding structure when air is blown into the inner tubular structure 12. When the expansion points 13*k* through 13*n* expand, they push the flap 14 inward allowing air to enter underneath the shirt. When the user blows into the inner tubular structure 12 through the air input tube 15, the expansion points expand and lift the shirt away from the skin. The lower rear portion expansion points lifts the slit and shirt and pushes in the flap 14. A valve 16 on the air input tube will maintain the level of air pressure in the inner tubular structure as long as the user desires to aid in the cooling of the surface portion of his or her skin. The valve is a simple rotary shut off valve, a capped push in valve or valve similar to the ones found on swimming aids that is closed after one has blown up the inner tubular structure in order to maintain the expansion. When one desires to retract the expansion points, the valve is opened and the air released.

While I have described my invention in connection with specific embodiments thereof, it is clearly to be understood that this is done only by way of example and not as a limitation to the scope of my invention as set forth in the objects thereof and in the appended claims.

I claim:

1. An inflatable clothing apparatus, for use by individuals active in outdoor pursuits, comprising:

an outer shell of clothing;

said outer shell of clothing comprising flexible material;

an inner tubular spiralled structure;

said inner tubular spiralled structure having expansion points at spaced apart intervals along said inner tubular spiralled structure;

flap means located under said expansion points located at the lower rear portion of said outer shell;

said expansion points lift said flap means when said expansion means are expanded for allowing ambient air to be introduced beneath said outer shell of clothing that convects upward and exits at the neck opening of said clothing;

said inner tubular spiralled structure having means for allowing air to be pumped into said inner tubular spiralled structure;

said inner tubular spiralled structure having means for retaining said air pumped into said inner tubular spiralled structure; and said inner tubular spiralled structure further having means for releasing the air pumped into said inner tubular structure.

2. An inflatable clothing apparatus, according to claim 1, wherein:

said inner tubular spiralled structure having adhesive means for attaching said inner tubular spiralled structure to said outer shell of clothing; and said adhesive means comprises glue based products.

3. An inflatable clothing apparatus, according to claim 1, wherein:

said air allowing means comprises an inflation valve for permitting the user to blow air into said inner tubular spiralled structure.

4. An inflatable clothing apparatus, according to claim 1, wherein:

said air releasing means comprises a locking mechanism for holding air in said inner tubular spiralled structure and releasing said air when desired to allow said outer shell of clothing to rest against the skin surface of the user.

* * * * *